US005246228A

United States Patent [19]

Hope, II

[11] Patent Number: 5,246,228

[45] Date of Patent: Sep. 21, 1993

[54] APPARATUS AND METHOD OF PLAYING BUNTBALL

[76] Inventor: Wayne A. Hope, II, 5238 Birchcrest Dr., Swartz Creek, Mich. 48473

[21] Appl. No.: 825,970

[22] Filed: Jan. 27, 1992

[51] Int. Cl.[5] ..... A63F 7/06; A63B 67/00

[52] U.S. Cl. ..... 273/88; 273/411

[58] Field of Search ..... 273/26 R, 26 B, 72 R, 273/58 R, 58 B, 411, 317, 89, 90, 88, 25

[56] References Cited

U.S. PATENT DOCUMENTS

| | | | |
|---|---|---|---|
| 969,424 | 9/1910 | Tilmes et al. | 273/89 |
| 2,031,161 | 2/1936 | Hamel | 273/72 R |
| 2,672,343 | 3/1954 | Augier | 273/90 |
| 2,776,139 | 1/1957 | Blamey, Jr. | 273/58 B X |
| 2,812,946 | 11/1957 | Hughes | 273/411 |
| 2,964,321 | 12/1960 | Anderson | 273/411 |
| 3,120,387 | 2/1964 | Weinstein | 273/26 B |
| 3,148,882 | 9/1964 | Zimmerman | 273/90 |
| 3,554,551 | 1/1971 | Apiki | 273/411 |
| 3,830,497 | 8/1974 | Peterson | 273/411 X |
| 4,088,319 | 5/1978 | Clarke | 273/58 K X |
| 4,758,002 | 7/1988 | Murphy | 273/411 |
| 4,798,389 | 1/1989 | Long | 273/411 |
| 4,805,916 | 2/1989 | Zentner | 273/411 X |
| 4,936,579 | 6/1990 | Barlow | 273/89 |
| 4,948,135 | 8/1990 | Follety | 273/90 |
| 4,973,061 | 11/1990 | Catherall | 273/411 |
| 5,002,284 | 3/1991 | Butler et al. | 273/411 X |
| 5,011,145 | 4/1991 | Bartkowicz | 273/26 B X |
| 5,014,984 | 5/1991 | Brockhoff | 273/26 B |

*Primary Examiner*—V. Millin
*Assistant Examiner*—Sebastiano Passaniti
*Attorney, Agent, or Firm*—James C. McLaughlin

[57] ABSTRACT

An apparatus for playing and a method of playing the ball type game called "Buntball" is disclosed. The game is characterized as being suitable for play by persons of differing skill, gender, or age and of being safe to play indoors or outdoors. The apparatus comprises a rectangular playing field without walls or ceiling, a homeplate in front of the playing field, a bat, and a ball. The playing field includes four subareas, and is preferably sixteen feet wide and twenty-four feet deep. Homeplate is preferably twelve feet away from the playing field. The bat and ball are preferably hollow and the ball is preferably perforated with small openings. The players are equally partitioned into two teams, each having at least one player. One team is positioned on the playing field with the goal of catching balls bunted thereto by a batter on the other team. The members of the team not on the playing field, attempt, one at a time, to bunt balls pitched by a member of the team on the playing field with the goal of bunting a ball onto the playing field without having it caught. If a ball is bunted onto the playing field without being caught, the subarea where the ball lands determines the number of imaginary bases that are advanced by an imaginary runner. Rules for playing Buntball are disclosed.

6 Claims, 2 Drawing Sheets

APPARATUS AND METHOD OF PLAYING BUNTBALL

TECHNICAL FIELD OF THE INVENTION

The technical field of the present invention is that of apparatus used to play, and methods of playing, ball type games played by two or more persons, one of whom (the pitcher) throws a ball toward a player (the batter) wielding an implement used to hit the ball (the bat). More specifically, the present invention relates to such ball type games that may be played by a variable number of players of various ages and levels of skill, that may be played in a relatively small area, that require no actual running-of-bases by players, that involve no touching of players, and that do not imperil nearby property. Additionally, the present invention is concerned with ball type games capable of being played indoors or outdoors without the need for walls or ceilings, games requiring the batter to hit the ball using a bunting motion, and games using a playing field that is essentially rectangular and easy to prepare.

BACKGROUND OF THE INVENTION

Sundry ball type games exist wherein a ball and a bat are used. The well known games of cricket and baseball are examples of such games that are played in many countries. Few ball type games are suitable for playing both indoors and outdoors. U.S. Pat. Nos. 4,758,002, 4,781,385, and 4,798,389 disclose ball type games playable indoors. These patents indicate a continuing desire for ball type games that may be played indoors. Each of these patents teach the use of walls to confine the balls and thus their playing volumes are somewhat difficult to prepare for play. Additionally, the patents teach the use of teams of from five to eight players, the movement of players from base to base, and appear to place no restrictions on the batter's swing. U.S. Pat. Nos. 4,758,002 and 4,781,385 provide a supplemental scoring area for batted balls striking certain portions of the walls.

The present invention includes among its major objects a ball type game capable of being played with as few as a total of two players (one per team), an apparatus for playing that includes no walls or ceilings and merely requires a series of straight lines to be drawn on a suitable horizontal surface, and a method of playing that facilitates the playing of the game by persons of differing skill, gender, or age.

SUMMARY OF THE INVENTION

The present invention achieves the above, and other, objects with the method of playing a ball type game and apparatus therefor that is disclosed below. Hereinafter the present invention shall be alternatively referred to by the name "Buntball."

The apparatus of the preferred embodiment of the present invention comprises an essentially flat, rectangular playing field laid out on the ground or floor that is partitioned into four subareas, a homeplate, a bat, and a ball. Each of the aforementioned subareas has associated with it a certain number of points that indicate how many imaginary bases a batter will advance if a bunted ball strikes the playing field without being caught. Homeplate is immediately in front of the playing field and is where the batter stands to receive a pitch. The bat and ball are selected to be commensurate with the skill of the players. In the preferred embodiment of Buntball, the bat is hollow and plastic, and the ball is hollow, perforated with holes, and plastic.

The preferred method of playing comprises a batter (standing in a proscribed way near homeplate) bunting a ball (pitched by a pitcher standing in the front part of the playing field) that is either caught or that falls on the ground or floor. If the bunted ball is caught, an out results. If the bunted ball strikes the ground without being caught, then the result depends on where the ball falls. The result may be an out, foul-strike, or a number of imaginary bases to be advanced. If the batter does not use a bunting motion, an out results. If the batter bunts but does not contact the ball, a strike is called. There is no result if a batter ignores a pitched ball. The pitcher continues to pitch balls until the batter is either out or advances a certain number of imaginary bases because a bunted ball fell into the playing field without being caught. Three strikes produce an out. Three outs and the teams exchange places (an "over"). A pair of overs constitutes an inning. Each advancement of four imaginary bases results in a score. The game ends when one of the following is true: (1) after two-and-a-half (2½) innings the team that would advance to bat has a higher score than the team just retired; (2) after three full innings one team has a higher score; or (3) additional innings are played until there is a winner if after three full innings the team scores are the same. Teams may agree to end play with a tied score.

The method of playing facilitates the playing of the game by persons of differing skill, gender, or age because: (1) the game attenuates the intimidating and violent aspects of many games by precluding the touching of one player by another, by requiring the pitcher not to leave the playing field until a ball is actually bunted, and by the use of a bat and ball that are unlikely weapons; (2) the game minimizes physical effort while emphasizing developable skills by requiring that only a relatively easy bunting motion be performed by the batter, by assigning no penalty if the batter chooses not to swing at a pitched ball, by requiring no actual running-of-bases, and by requiring an underhand pitching motion; and (3) the game may easily and quickly be erected and torn down because one only needs to place and to remove straight lines or markers on a level area and because the level area may be almost anywhere since so little hazard is presented by the moving ball to persons and property.

DETAILED DESCRIPTION OF THE INVENTION AND ITS PREFERRED EMBODIMENT

Figure 1:
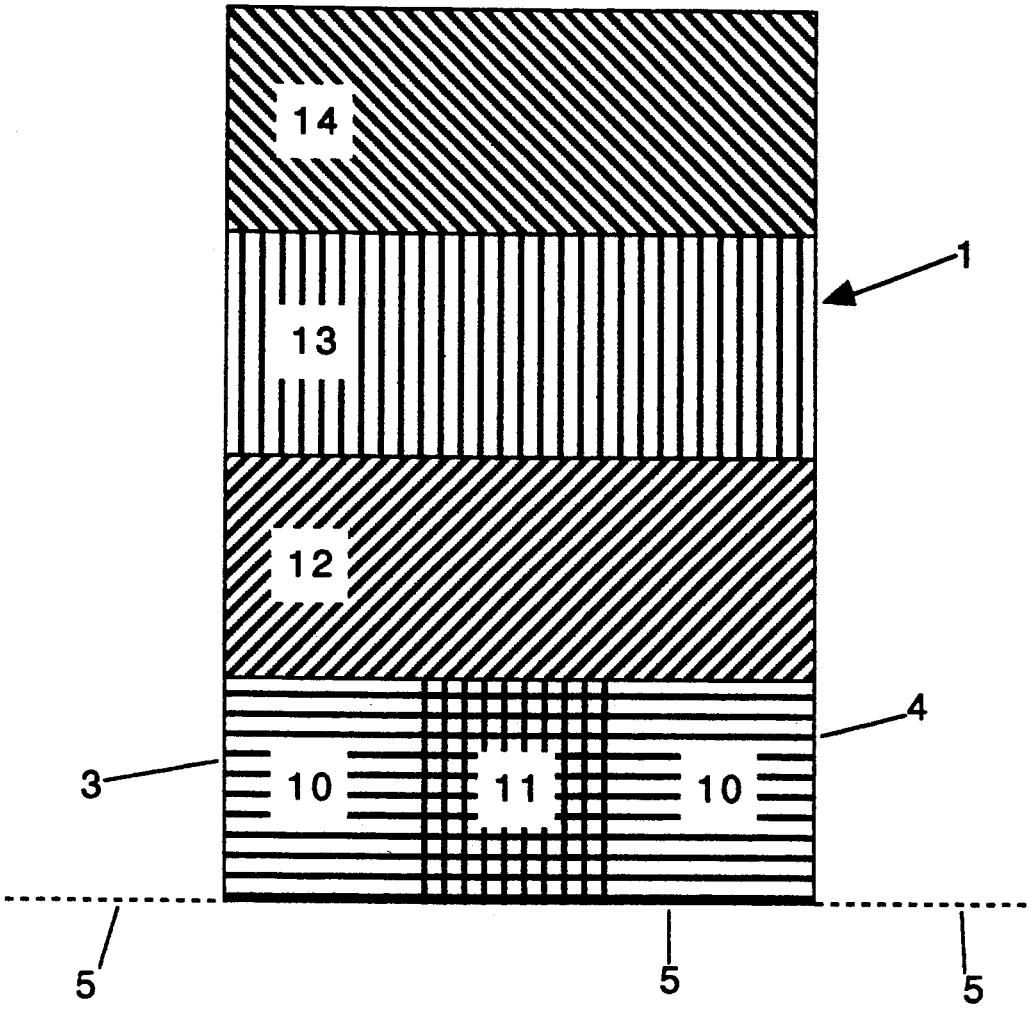
FIG. 1 is a top view of the playing area
Figure 1:
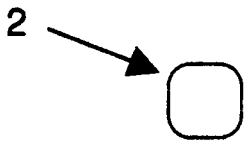

The apparatus of the preferred embodiment of the present invention comprises a playing area, shown on FIG. 1, a bat, and a ball. The playing area comprises playing field 1 and homeplate 2.

The playing field 1 is rectangular, and preferably sixteen feet wide and twenty-four feet deep. It is bounded on the left and right by left foul line 3 and right foul line 4. The front of playing field 1 is indicated by front line 5. Front line 5 extends six feet to the left and right of left foul line 3 and right foul line 4, respectively. Thus, front line 5 has a total length of twenty-eight feet. Playing field 1 is subdivided into four, equal rectangular areas along its depth. Each of the areas is sixteen feet wide and six feet deep. Starting at front line 5, the areas are in order: single area 10, double area 12, triple area 13, and homerun area 14. Playing field 1 may be inside a structure or out of doors.

Homeplate 2 is positioned so as to be centered on front line 5 and is preferably twelve feet away from playing field 1. The middle one-third of single area 10 is designated the pitcher's area 11.

Figure 2:
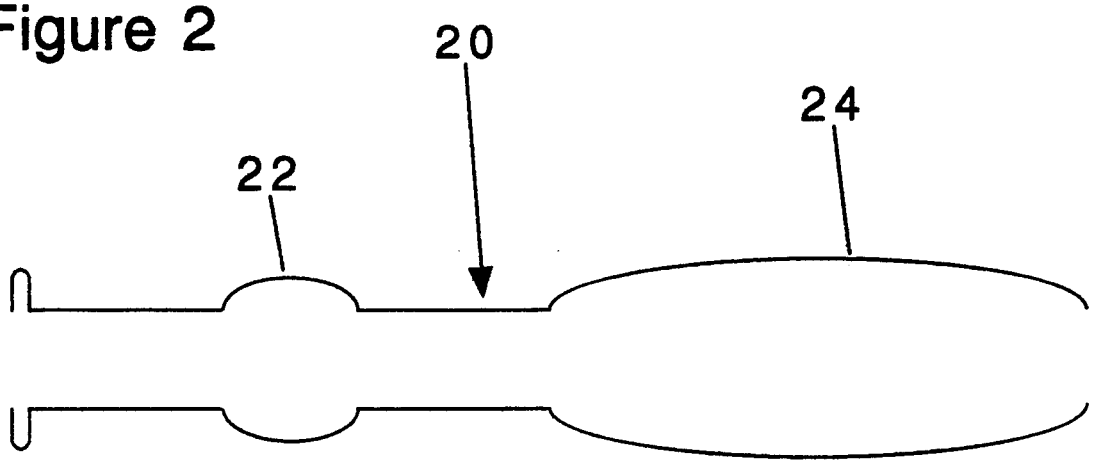
FIG. 2 is a cross section view of the preferred bat

The preferred bat 20 is shown on FIG. 2. It is tubular, hollow, plastic, about 26 to 28 inches long, and about 3 to 5 inches in diameter in the striking area 24. While the handle of bat 20 may have an approximately uniform diameter with markings to indicate the placement of the batter's hands, it is preferred that the handle have a pronounced bulge 22 separating where the batter's hands are to be placed. The bulge 22 may be formed as part of bat 20 (as shown on FIG. 2) or may be effected by placing material around bat 20. The center to center spacing of the batter's hands is to be about eight inches.

Figure 3:
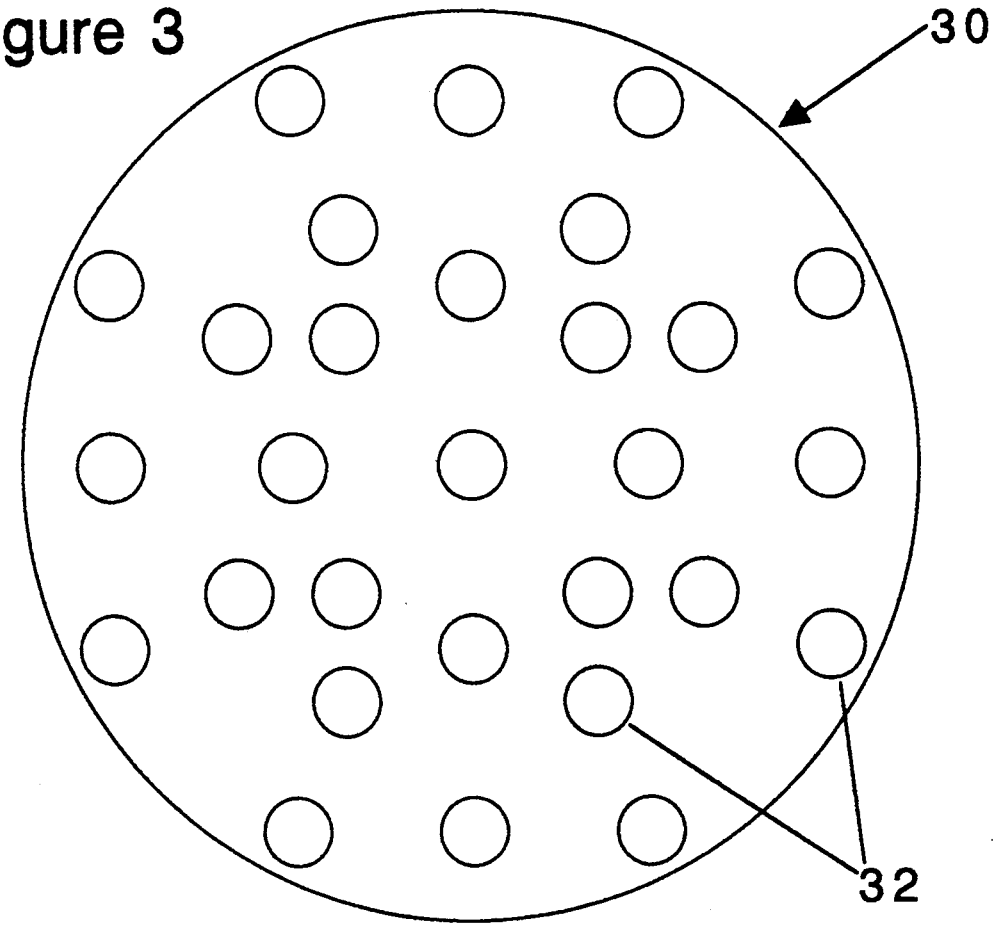
FIG. 3 is a perspective view of the preferred ball

The preferred ball 30 is shown on FIG. 3. It is spherical, about 5 inches in diameter, plastic, hollow, and perforated by numerous circular openings 32 each having a diameter somewhat smaller than the minimum diameter of a human finger (about one centimeter).

The above noted particulars for the apparatus of the preferred embodiment have been found to be appropriate when the game is played for recreation and are especially appropriate when played by persons of differing skill, gender, or age. The above specified preferred bat 20 and ball 30 are expected to result in a low risk of injury to players and damage to property because it is virtually impossible to impart dangerous levels of kinetic energy into ball 30 when bunted by bat 20 and because the initial kinetic energy of ball 30 is rapidly dissipated. Other ball and bat combinations will produce a similar result.

The present invention is amenable to modifications of the apparatus. It may be desirable to use a larger playing area (particularly if it is desired to have more than three persons on a team) or a more firm and dense ball and bat (especially if a larger playing area is used, fragile property is distant, or players have a relatively high level of skill).

The preferred set of rules for playing the preferred embodiment of the present invention includes the required playing area, bat, and ball described above and:

Players

There are two teams. Each team has an equal number of playing members. Teams may preferably have one, two, or three members. At any given time, one team is an offensive or hitting team and the other team is the defensive or fielding team.

A player is said to be beyond front line 5 if he or she is on the same side of front line 5 as playing field 1. A player is said to be forward of front line 5 if he or she is on the same side of front line 5 as homeplate 2.

The Defensive Team

The defensive team includes a pitcher, who must remain within pitcher's area 11 while pitching and no part of the pitcher is to cross front line 5 until the ball is hit. The pitcher is to pitch a ball to the batter on the offensive team. Any other members of the defensive team must be within playing field 1 when a ball is pitched and until the ball is hit.

The Offensive Team

The offensive team is composed of batters. A batting rotation, or sequence, is determined by the offensive team and each team member in turn advances to become a batter. The batter must stand next to homeplate 2 while awaiting a pitch. (See the Batting section for the proper stance to be taken by the batter.)

Pitching

When pitching, the pitcher remains in pitcher's area 11 until the ball is hit. The pitcher is to pitch the ball with an underhand motion toward homeplate 2. The path taken by the ball must be such that the ball is always above playing field 1 and below the top of the batter's head, and such that the ball is level with the batter's waist when the ball reaches homeplate 2. A pitched ball not conforming to these requirements is considered invalid or a no-pitch and is repitched without penalty. As a new batter advances to bat, it is the pitcher's responsibility to announce aloud the game's status (placement of any imaginary runners, number of outs in the present inning, score, and inning).

Batting

The batter must stand, and remain, just to the left or to the right of homeplate 2 (known as the batter's circle) with his or her toes pointing toward pitcher's area 11. The batter's shoulders are parallel to front line 5. The batter may bend at the knees and waist as long as the shoulders remain parallel to front line 5. The batter is not to rotate at the waist and thus cause the shoulders no longer to be parallel to front line 5. The correct stance encourages the batter to push or bunt using a punching movement of both wrists and discourages a swinging motion. The bat is to be held by the batter with both hands. One hand is positioned at or near the end of the bat and the other hand is positioned about eight inches farther up the bat. Distinctive marks may be placed on the bat to indicate the proper placement of the hands or a bulge 22 may be placed between where the hands are to be placed. The batter is to strike the pitched ball with the bat using a bunting motion. The bat is held parallel to the waistline and close to the body. When attempting to meet the pitched ball, the arms are extended toward front line 5. The bunting motion uses a punching motion of both wrists and maintains the bat essentially parallel to front line 5. If a ball is struck when the bat is pulled back or swung so that the bat is not parallel to front line 5, then it will be an improper hit and result in an out.

Outs

Teams exchange roles every time their team accumulates three outs (an "over"). Outs are incurred as follows:

Three strikes make an out. A strike is earned if a batter bunts and completely misses a correctly pitched ball. A foul-strike is earned if a batter bunts a correctly pitched ball but the ball neither touches nor crosses front line 5 (or its extension). A foul-strike is also earned if a defensive player catches and then drops a bunted ball when the defensive player's feet are forward of front line 5. A foul-strike counts as a strike only if one or zero strikes have occurred prior to the foul-strike. A foul-strike occurring after two strikes is ignored.

A ball that bounces off a batter's bat, crosses front line 5, and then first touches the ground outside of playing field 1, is an out.

A ball that bounces off a batter's bat, first strikes the ground before front line 5, and then crosses or touches front line 5 is an out.

A ball that bounces off a batter's bat and is caught in flight by a member of the defensive team constitutes an out.

A ball that is hit with a swinging motion, rather than a bunting motion, or a ball that is hit too hard constitutes an out.

A ball that is pitched too high or too low constitutes a no-pitch and is repitched without penalty if the batter does not attempt to hit such a ball. If the batter does attempt to hit such a ball, he or she receives the result of such an action as if the ball were properly pitched.

Scoring

The object of the offensive team is to bunt the pitched ball onto playing field 1 without the ball being caught by a member of the defensive team. A value is awarded for each ball not caught depending upon where the ball falls onto playing field 1. The task of the defensive team is to pitch balls in a proper manner toward homeplàte 2 and to try to catch bunted balls that would otherwise fall onto playing field 1.

A bunted ball falling onto playing field 1 earns a value equal to either the value of the area upon which it falls (one for single area 10, two for double area 12, three for triple area 13, or four for homerun area 14) or to the value of the area upon which a defending team member's feet were placed when he or she first touched the ball if the ball is then dropped. A ball that drops on the dividing line between areas earns for the batter the higher value of the two areas. If a defending player touches a bunted ball and then he, she, or another defensive player drops the ball, the batter is awarded a value equal to the larger value of the areas present under the defending player's feet when the ball was first touched.

The award points are used to advance imaginary runners around four imaginary bases. An imaginary runner advances only if forced off the base it occupies by an advancing runner. Thus an imaginary runner on third base does not advance to fourth base until another imaginary runner should occupy third base. A score occurs for each imaginary runner advanced to the fourth (or home) base. Every time the teams change places (after three outs) all imaginary runners are removed from the imaginary bases.

The game ends when one of the following is true: (1) after two-and-a-half (2½) innings the team that would advance to bat has a higher score than the team just retired; (2) after three full innings one team has a higher score; or (3) additional innings are played until there is a winner if after three full innings the team scores are the same. Teams may agree to end play with a tied score.

Miscellaneous

A member of the offensive team returns pitched balls that are not hit. A net placed behind the batter and homeplate 2 may simplify the returning of pitched balls. Players do not use gloves.

The preferred embodiment of the present invention has been described in detail. The embodiment described is illustrative and not restrictive.

I claim:

1. A method of playing a ball type game by a first and second team, each team composed of at least one player, comprising the steps of:

designating a playing area that is essentially flat, without walls or ceilings, and includes a plurality of scoring areas;

equipping the players with a bat having a length greater than eight inches and a ball;

providing a set of rules including the requirements that 1) players of the first team guard said scoring areas, 2) a player of the first team pitch said ball toward players of the second team who are to bunt, and only bunt, said ball toward said scoring areas, 3) pitching is required to comprise an underhand motion, a ball path such that said ball is always above said playing area and below the top of the batter's head, a ball path such that said ball is level with the batter's waist when said ball reaches the batter, and where pitched balls not conforming to said pitching requirements are repitched without penalty, 4) bunting is required to be effected by the batter standing with shoulders maintained equidistant from the pitcher, holding said bat with both hands, using a punching motion of both wrists to strike a pitched ball, and where a penalty is assessed against a batter not using said bunting requirements to strike a pitched ball, and 5) when a bunted ball strikes said playing area without being caught and held by a player of the first team, the second team receives either a benefit or a disadvantage depending on whether a scoring area is or is not involved; and requiring the players to play according to said rules.

2. A method according to claim 1, wherein said holding of said bat with both hands further comprises positioning one hand at or near the end of said bat and positioning the other hand about eight inches farther up said bat.

3. A method according to claim 2, wherein said bat is provided with a bulge to either side of which a player's hands are to be placed.

4. A method according to claim 2, wherein said holding of said bat with both hands further comprises holding said bat parallel to the waistline and close to the body.

5. A method of playing a ball type game by two teams of at least one player each, comprising the steps of:

designating a playing field that is essentially flat, devoid of walls and ceilings, and rectangular, said playing field having a front, a back, a depth, and a width;

subdividing said playing field into a plurality of equal rectangular scoring areas along said depth;

designating a homeplate area centered in front of said playing field;

equipping the players with a bat having a length greater than eight inches and a ball;

providing a set of rules;

requiring the players to play a game according to said rules involving the players of one team in turn bunting, and only bunting, said ball, using said bat, toward members of the other team who are on said playing field, wherein said bunting requires the batter (1) to stand, and remain next to said homeplate area with toes pointing towards said front and with shoulders parallel to said front, (2) to hold said bat with both hands, one positioned at or near the end of said bat and the other about eight inches farther up said bat, and (3) to strike at said ball with a punching motion of both wrists while maintaining said bat essentially parallel to said front;

requiring one member of the team on said playing field to pitch said ball towards the batter with an underhand motion, to remain within a small area of said playing field while pitching, and to cause the path of said ball to be such that the ball is always above said playing field, below the top of the batter's head, and level with the batter's waist when said ball reaches said homeplate area; and requiring a pitched ball not conforming to said requirements to be considered invalid or a no-pitch and to be repitched without penalty.

6. A method according to claim 5 wherein the pitcher is also required to announce aloud the game's status as a batter advances to bat.

* * * * *